United States Patent [19]

Takasaki

[11] Patent Number: 4,779,811

[45] Date of Patent: Oct. 25, 1988

[54] GRINDING ROLL

[76] Inventor: Takao Takasaki, 4-7, Iwasaki 2-Chome, Nichinan-shi, Miyazaki 887, Japan

[21] Appl. No.: 125,215

[22] Filed: Nov. 25, 1987

Related U.S. Application Data

[62] Division of Ser. No. 851,140, May 20, 1986, Pat. No. 4,747,552.

[30] Foreign Application Priority Data

Jul. 31, 1984 [JP] Japan ..... 59-162152

[51] Int. Cl.[4] ..... B02C 4/30

[52] U.S. Cl. ..... 241/293

[58] Field of Search ..... 241/282.1, 282.2, 292.1, 241/293

[56] References Cited

U.S. PATENT DOCUMENTS 3,036,614 5/1962 Knapp ..... 241/292.1

3,039,505 6/1962 Mast ..... 241/292.1

3,472,298 10/1969 Vinogradov et al. ..... 241/293 X

*Primary Examiner*—Timothy V. Eley

*Attorney, Agent, or Firm*—Cushman, Darby & Cushman

[57] ABSTRACT

In a roll grinding blade for the production of starch from starch plants such as potatoes and for the production of processed food or juice from root crops, fruits, vegetables or the like, the roll grinding blade comprises rhombic blade members having leading blade tips (5) formed at the top ends with an acute angle and cutting blade tips (6) formed at each of the edges where the side surfaces meet the upper and the lower surfaces and stacked by way of recessed grooves (7), and said stacked blade members are fitted to the circumference of a rotational roll. The number of the cutting blade edges (6) is increased by the stacking of the rhombic blade members which, coupled with the leading blade tips (5) of an acute angle, significantly improves the effect of grinding the matters to be processed.

7 Claims, 2 Drawing Sheets

GRINDING ROLL

DESCRIPTION

This is a division application of Ser. No. 851,140 which is now U.S. Pat. No. 4,747,552, filed May 20, 1986.

TECHNICAL FIELD

This invention concerns a roll grinding blade for the production of starch from starch plants such as potatoes, as well as for the production of processed food or juice such as from root crops, fruits and vegetables.

BACKGROUND ART

Conventional trigonal cone- and saw teeth-like roll grinding blades have a drawback that the product recovery rate is lowered as the grinding efficiency is increased.

That is, the roll grinding blades for the production of sweet potato starch have trigonal cone-like blade elements set to a rotational roll made of highly soft steels, in which the best starch recovery rate is obtainable when the easily abrading blade elements are abraded such that the crests of the trigonal cones are abraded by about one-half into a trapezoidal shape. However, the blade elements abraded to the trapezoidal shape involve a defect that not only the grinding efficiency is reduced but also they fail to perform complete grinding, for example, by yielding chips, i.e., waste pieces of potatoes, thus requiring re-grinding by a grinder.

There has been a roll grinding machine for the production of Irish potato starch having saw teeth-like grinding blades which can detachably be mounted to a roll but, since the saw teeth-like shape undergoes a great resistance and requires abrasion, it has a defect that the detaching and attaching device to the roll is complicated to increase the cost and that it can not be utilized for the production of sweet potato starch because of the low product recovery rate.

Grinding of root crops, fruits, vegetables, etc. by a grinder for the production of processed food or juice therefrom involves a demerit of poor fabrication efficiency.

The cutter of a juicer also has a defect that the blade elements, being of a trigonal cone- or trigonal plate-like shape, are not satisfactorily bite into the material to be processed and are abraded rapidly.

The rotational blade shown in Japanese Patent Application No. Sho 59-037431 also has a drawback that the grinding efficiency is reduced if the starch recovery rate is increased.

That is, all of the conventional grinding blades have a conflicting relationship between the product recovery rate and the grinding efficiency. Therefore, they are defective in that the grinding efficiency can not be improved.

The conflicting relationship between the product recovery rate and the grinding efficiency is caused by that all of the blade elements of the conventional grinding blades are mono-layered blades.

The object of this invention is to overcome the problems in the drawbacks of the conventional mono-layered blades and provide a grinding blade capable of improving the grinding efficiency remarkably without reducing the quality or the recovery rate of products.

DISCLOSURE OF INVENTION

Accordingly, this invention basically concerns a stacked blade which is suitable to the grinding of matters to be processed such as the pulverization of starch cell membranes and formed by stacking protruding plate-like blade members as desired.

Specifically, this is a blade member comprising protruding plate-like blade elements each of a flat and rhombic planar shape and having leading blade tips at the top ends on the left and right sides meeting each other with an acute angle and cutting blade tips at the respective edges thereof where the side surfaces meet the upper and the lower surfaces, which are stacked by an appropriate number as desired.

The roll grinding blade has a feature in that the stacked blade members are arranged at the circumferential surface of a rotational roll with the leading blade tips being directed to the rotating direction, by any method such as of mounting fixedly or detachably to the rotational roll.

BRIEF DESCRIPTION OF THE DRAWINGS

The drawings show an embodiment of the roll grinding blade according to this invention, wherein.

BEST MODE FOR CARRYING OUT THE INVENTION

For describing this invention more in detail, an embodiment for the best mode will be explained hereinafter in accordance with the appended drawings.

Figure 1:
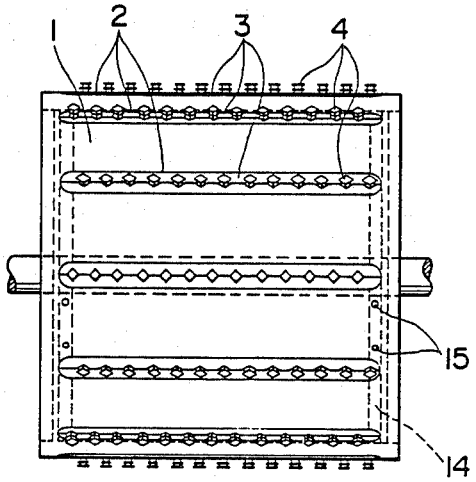
FIG. 1 is a front elevational view of the roll grinding blade according to this invention.
Figure 2:
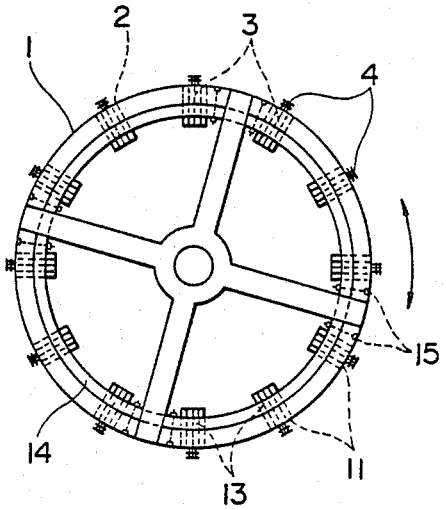
FIG. 2 is a side elevational view thereof.
Figure 3:
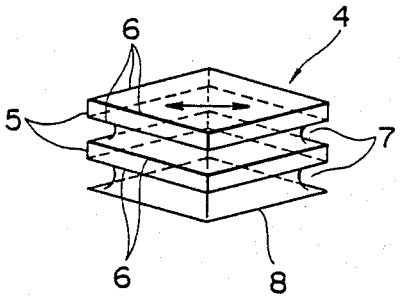
FIG. 3 is an enlarged perspective view of a blade member of the roll grinding blade as a main portion of this invention.
Figure 4:
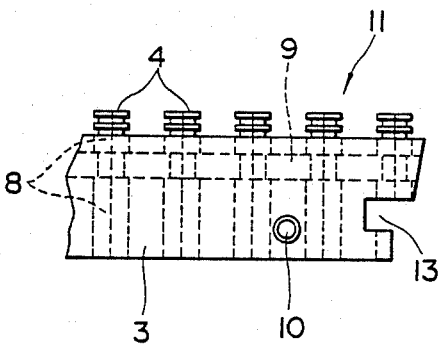
FIG. 4 is a front elevational view of a blade with base.
Figure 5:
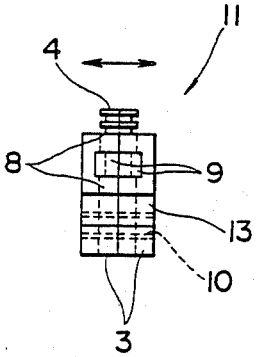
FIG. 5 is a side elevational view thereof.
Figure 6:
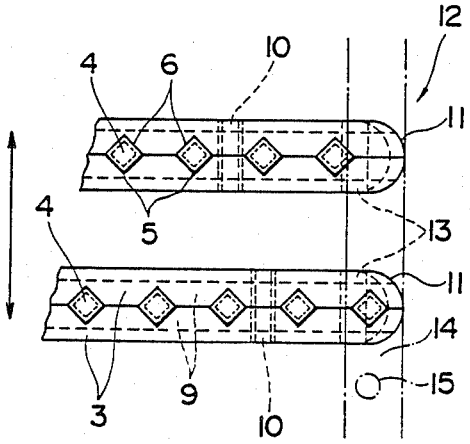
FIG. 6 is a plan view of a combined blade in which the blade members are arranged, arrows in FIGS. 2, 3, 5 and 6 showing the rotating direction.

FIGS. 1 and 2 show a roll grinding blade in which detachable blade members 4 with base 3 are attached to recessed holes 2 formed in a roll 1. FIG. 3 is an enlarged perspective view of a blade member 4 on the roll in which a plurality of protruding plate-like blade elements with leading blade tips 5 and cutting blade tips 6 are formed by stacking them by way of recessed grooves 7. FIGS. 4, 5 and 6 show blades 11 with base in which blade legs 8 of the blade members 4 are disposed at a predetermined distance on the base 3 and seized between securing plates 9 and rivetted at 10. Securing with adhesives may also be employed instead of rivetting at 10. A plurality of the blades 11 with base constitute a combined blade 12 in which the blade members 4 are situated while being staggered from each other as shown in FIG. 6. They are fitted into the recessed holes 2 in the roll 1, rings 14 are fitted to the recesses 13 on both ends of the blades 11 with base, and the rings 14 are secured by screws 15 to the roll 1.

Accordingly, it is suitable to the grinding of matters to be processed such as pulveration of starch cell membranes. The blade member comprising the stacked protruding plate-like blade elements can be made greater in the blade height than the mono-layered blade member and contain a number of acute cutting blade tips 6, i.e., breaking lines and blade members bite well into the matters to be processed with no objection. The rhombic blade member having leading blade tips at both ends can detachably be mounted to the roll and the blade member can be formed with abrasion resistant material such as tungsten or ceramic.

The blade members can detachably be mounted also to the inner surfaces of cylindrical, conical, net-shaped or like other rolls, as well as to a rotating disk such as the cutter of a juicer.

Thus, the grinding efficiency can significantly be increased without reducing the quality or the recovery rate of the product by the blade members, in which protruding plate-like blade elements are stacked. Further, it can perform grinding with no requirement for running water, is suitable to pulverization and also enables operation over a long period of time by the use of the blade members capable of withstanding long time use.

INDUSTRIAL APPLICABILITY

As has been described above, this invention is useful as a grinding blade of a roll grinding machine for the production of starch from starch plants such as potatoes, as well as for the production of processed food or juice from root crops, fruits, vegetables, etc. in that it can improve the grinding efficiency by from 2 to 3 times or greater than that of the conventional machines.

Further, it is useful as a roll grinding blade or roll pulverization blade capable of grinding and pulverizing fabrication at high efficiency over a broad range from agricultural, forestry, stock breeding and marine products to industrial and mineral products, such as grinding of chicken heads including both soft and hard textures, as well as pulverization of fish meat products, crops, wood materials and plastics.

Furthermore, it is also useful being utilizable as blade members for the rotating disk such as the cutter of a juicer or the like.

I claim:

1. A grinding roll for a roll grinding machine comprising:

a cylindrical body member; and at least one planar blade element, each said blade element having a flat, rhombic shape so as to include two acute angled corners, to obtuse angle corners and four cutting edges disposed about the periphery thereof, each said blade element being mounted to the grinding roll such that said blade element is substantially parallel to a circumference of said grinding roll.

2. A grinding roll for a roll grinding machine as in claim 1, wherein a plurality of blade members are mounted to the circumference of said body member, each said blade member including a plurality of said blade elements coupled together in bottom-to-top, parallel relation so as to define a stack of blade elements, each of said blade member being mounted to said body member such that the blade elements are disposed substantially parallel to the circumference of the body member.

3. A grinding roll as in claim 2, wherein each said stack of blade elements includes two blade elements.

4. A grinding roll for a roll grinding machine comprising:

a cylindrical body member; and a plurality of blade members mounted to a circumference of said body member, each said blade member including a plurality of planar blade elements coupled together in bottom-to-top, parallel relation so as to define a stack of blade elements, each of said blade elements having a flat, rhombic shape so as to include two acute angled corners, two obtuse angled corners and four cutting edges disposed about their periphery thereof;

each said blade member being mounted to said body member such that the blade elements thereof are disposed substantially parallel to the circumference of said body member and such that the acute angled corners of said blade elements are oriented to extend at an angle relative to a longitudinal axis of said body member.

5. A grinding roll as in claim 4, wherein said blade members are mounted to said body member such that the acute angled corners of said blade elements are disposed at an angle of about 90° relative to a longitudinal axis of said body member.

6. A grinding roll as in claim 4, wherein each said blade member includes two blade elements coupled together.

7. A grinding roll as in claim 4, wherein said blade members are mounted to said body member so as to form a plurality of longitudinal rows of blade members about the circumference of said body member.

* * * * *